US012780580B2

(12) United States Patent
Nozawa

(10) Patent No.: US 12,780,580 B2
(45) Date of Patent: Nov. 3, 2026

(54) TAPE RELEASING DEVICE AND TAPE LOADING DEVICE

(71) Applicant: FUJI CORPORATION, Chiryu (JP)

(72) Inventor: Mizuho Nozawa, Kota-cho (JP)

(73) Assignee: FUJI CORPORATION, Chiryu (JP)

( * ) Notice: Subject to any disclaimer, the term of this patent is extended or adjusted under 35 U.S.C. 154(b) by 95 days.

(21) Appl. No.: 18/863,154

(22) PCT Filed: May 31, 2022

(86) PCT No.: PCT/JP2022/022124

§ 371 (c)(1),
(2) Date: Nov. 5, 2024

(87) PCT Pub. No.: WO2023/233521

PCT Pub. Date: Dec. 7, 2023

(65) Prior Publication Data

US 2026/0042630 A1 Feb. 12, 2026

(51) Int. Cl.

| | |
|---|---|
| ***H05K 13/02*** | (2006.01) |
| ***B65H 19/10*** | (2006.01) |
| ***B65H 19/12*** | (2006.01) |

(52) U.S. Cl.

CPC ..... *B65H 19/105* (2013.01); *B65H 19/12* (2013.01); *B65H 2301/3251* (2013.01); *B65H 2405/461* (2013.01); *B65H 2405/55* (2013.01)

(58) Field of Classification Search

CPC ..... B65H 19/12; B65H 19/105; B65H 2301/3251; B65H 2405/461;

(Continued)

(56) References Cited

U.S. PATENT DOCUMENTS 5,310,301 A * 5/1994 Aono ..... H10P 72/0442 226/62
5,419,802 A * 5/1995 Nakatsuka ..... H05K 13/0419 156/941

(Continued)

FOREIGN PATENT DOCUMENTS

EP 2 938 177 A1 10/2015
JP 4-327466 A 11/1992

(Continued)

OTHER PUBLICATIONS

International Search Report issued Jul. 5, 2022 in PCT/JP2022/022124, filed on May 31, 2022, 2 pages.

*Primary Examiner* — Shelley M Self
*Assistant Examiner* — David G Shutty
(74) *Attorney, Agent, or Firm* — Oblon, McClelland, Maier & Neustadt, L.L.P.

(57) ABSTRACT

A tape releasing device includes a reel support section and a release section. The reel support section is configured to support a reel in which an outer peripheral portion of a spiral tape, where a carrier tape, in which a cover tape that closes an accommodation section that accommodates an electronic component is attached to a base tape provided with the accommodation section, is spirally wound, and a tip end portion of the cover tape are fixed by a fixing tape. The release section releases the fixing tape of the reel supported by the reel support section.

8 Claims, 8 Drawing Sheets

(58) Field of Classification Search
CPC .... B65H 2405/55; B65H 16/00; B65H 26/00; B65H 35/00; H05K 13/0419
See application file for complete search history.

(56) References Cited

U.S. PATENT DOCUMENTS 5,531,859 A * 7/1996 Lee ..... B65H 37/002 156/701
6,162,007 A * 12/2000 Witte ..... B65H 20/22 221/72

FOREIGN PATENT DOCUMENTS

| | | | | |
|---|---|---|---|---|
| JP | H04327466 | A | * | 11/1992 |
| JP | 2003-72835 | A | | 3/2003 |
| JP | 2003072835 | A | * | 3/2003 |
| JP | 2010150008 | A | * | 7/2010 |
| JP | 2019-201156 | A | | 11/2019 |
| JP | 2019-204858 | A | | 11/2019 |
| WO | WO 2014/097473 | A1 | | 6/2014 |

* cited by examiner

TAPE RELEASING DEVICE AND TAPE LOADING DEVICE

TECHNICAL FIELD

The present description herein discloses techniques related to a tape releasing device and a tape loading device.

BACKGROUND ART

A pre-use component tape recognition section described in Patent Literature 1 performs image processing on an imaging result of a component reel and recognizes a tip end portion of a pre-use tape stored in the component reel. Further, a component tape setting processing section described in Patent Literature 1 causes a robot section and a pre-use tape holding tool based on a recognition result of the pre-use component tape recognition section to hold the tip end portion of the pre-use tape. Specifically, the tip end portion of the pre-use tape is gripped and held by a clip portion in the pre-use tape holding section.

An automatic tape processing apparatus disclosed in Patent Literature 2 processes so that a tip end of a top tape of a component packaging tape wound around a tape reel protrudes by a predetermined protrusion length from a tip end of a carrier tape. In the automatic tape processing apparatus disclosed in Patent Literature 2, a worker inserts the tip end portion of the component packaging tape into a tape entrance.

Patent Literature

Patent Literature 1: JP 2019-204858 A
Patent Literature 2: WO 2014/097473

BRIEF SUMMARY

Technical Problem

A carrier tape is spirally wound on a reel. A tip end side of the carrier tape can be fixed to an outer peripheral portion of the spiral tape by a fixing tape. When the reel in which the tip end side of the carrier tape is fixed by the fixing tape is set in a feeder, it is necessary to release the fixing tape. When a worker performs the release of the fixing tape, the number of work steps of the worker increases.

In view of such circumstances, the present description herein discloses a tape releasing device and a tape loading device capable of releasing a fixing tape of a reel.

Solution to Problem

The present description herein discloses a tape releasing device including a reel support section and a release section. The reel support section is configured to support a reel in which an outer peripheral portion of a spiral tape, where a carrier tape, in which a cover tape that closes an accommodation section that accommodates an electronic component is attached to a base tape provided with the accommodation section, is spirally wound, and a tip end portion of the cover tape are fixed by a fixing tape. The release section is configured to release the fixing tape of the reel supported by the reel support section.

The present description herein discloses a tape loading device including the tape releasing device described above and a loading section. The loading section is configured to load the carrier tape of the spiral tape, from which the fixing tape has been released, to a feeder configured to supply the electronic component to a collection position.

Advantageous Effects

With the above tape releasing device, the fixing tape of the reel can be released. The tape loading device includes the tape releasing device. Therefore, what has been described above with respect to the tape releasing device can be said to be the same for the tape loading device.

DESCRIPTION OF EMBODIMENTS

1. Embodiments

Figure 1:
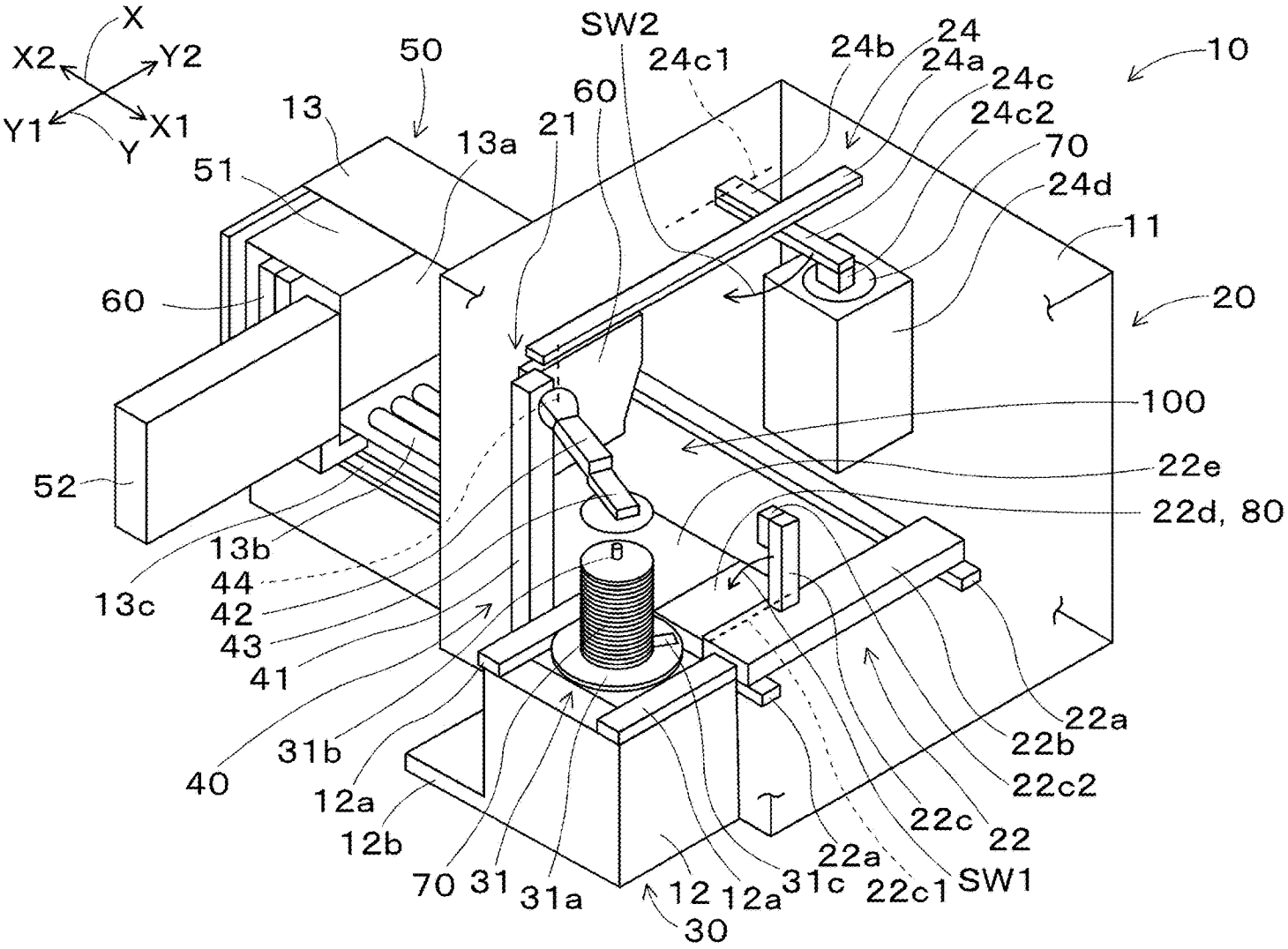
FIG. 1 is a perspective view illustrating an example of a setup device.

1-1. Configuration Example of Setup Device 10

For example, tape releasing device 80 and tape loading device 100 can be applied to setup device 10. Setup device 10 sets reel 70 on feeder 60 so that electronic component 91 can be supplied from feeder 60. Setup device 10 need only automatically set reel 70 on feeder 60, and may take various configurations.

Figure 2:
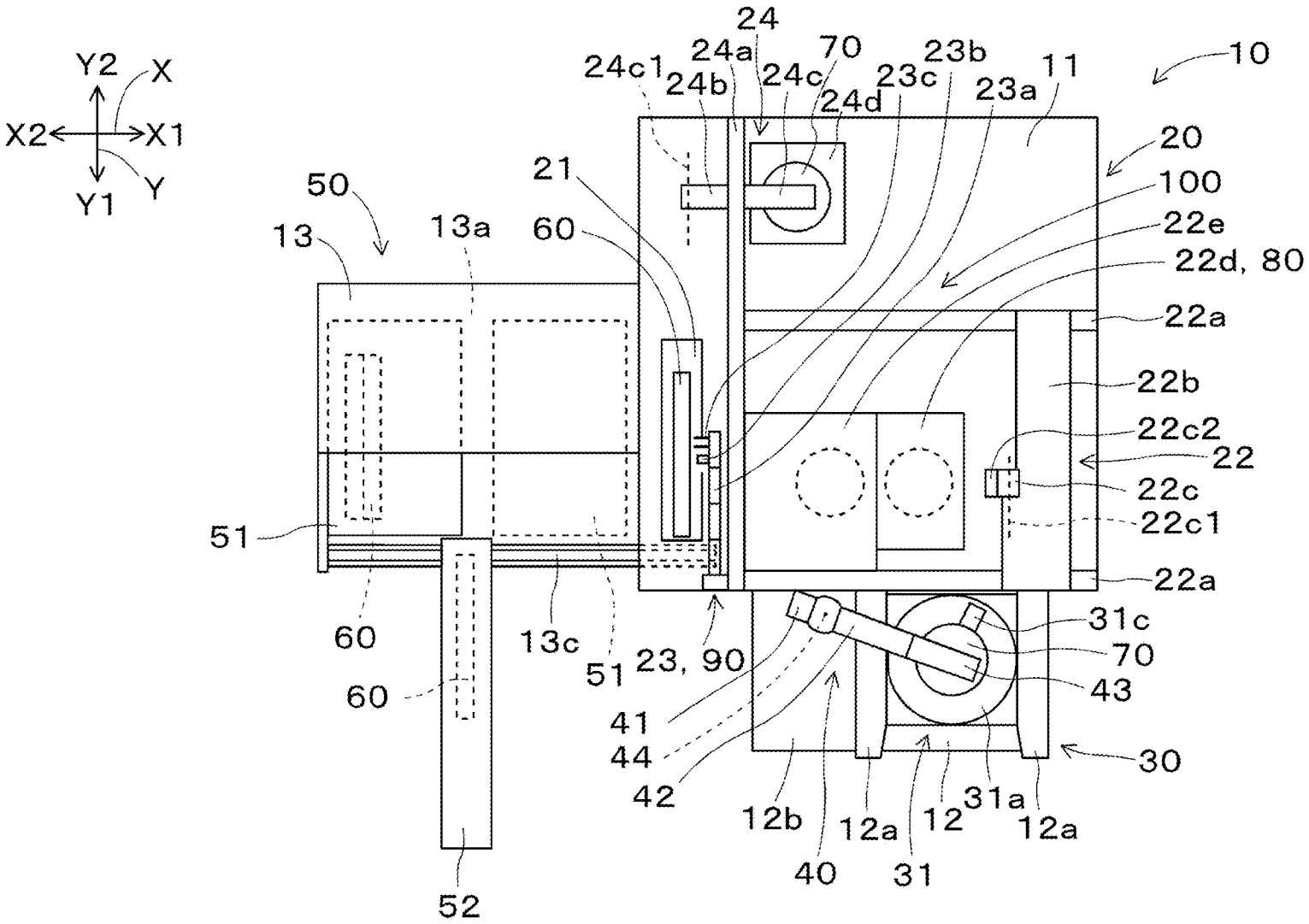
FIG. 2 is a plan view of the setup device in FIG. 1.
Figure 3:
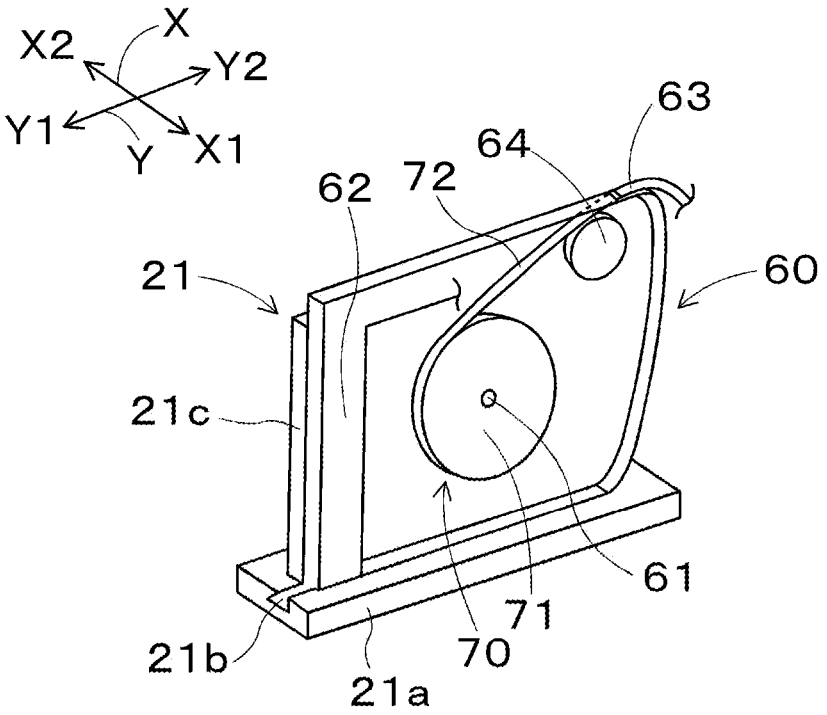
FIG. 3 is a perspective view illustrating an example of a feeder provided in a feeder holding section.

As illustrated in FIGS. 1 to 3, setup device 10 of an embodiment includes reel attachment/detachment section 20, reel supply section 30, reel transfer mechanism 40, and feeder supply section 50. For convenience of description, in the drawings, a facing direction of feeder 60 and reel 70 when reel 70 is attached to and detached from feeder 60 is referred to as a first direction (arrow X direction). In the first direction (arrow X direction), a direction (side) from feeder 60 toward reel 70 is referred to as a first end side (arrow X1 direction) in the first direction, and a direction (side) from reel 70 toward feeder 60 is referred to as a second end side (arrow X2 direction) in the first direction.

Further, as illustrated in FIG. 3, a sliding direction of feeder 60 in slot 21*b*, which is a direction orthogonal to the first direction (arrow X direction) in a horizontal plane, is referred to as a second direction (arrow Y direction). In the second direction (arrow Y direction), a sliding direction (side) when feeder 60 is detached is referred to as a first end side (arrow Y1 direction) in the second direction, and a sliding direction (side) when feeder 60 is attached is referred to as a second end side (arrow Y2 direction) in the second direction.

In reel attachment/detachment section 20, various members are assembled inside first housing 11. First housing 11 is a case having a rectangular parallelepiped shape, and a second end side (arrow X2 direction) in the first direction and a first end side (arrow Y1 direction) in the second direction are partially opened. Reel supply section 30 is provided to be coupled to a first end side (arrow Y1 direction) in the second direction of reel attachment/detachment section 20. Reel supply section 30 is formed in box-shaped base 12 smaller than first housing 11. Reel transfer mechanism 40 is provided on plate base 12*b* extending from a bottom portion of base 12 to a second end side (arrow X2 direction) in the first direction. Feeder supply section 50 is provided to be coupled to the second end side (arrow X2 direction) in the first direction of reel attachment/detachment section 20. In feeder supply section 50, various members are assembled inside second housing 13 which is smaller than first housing 11 and has storage space 13*a* in an upper portion.

Reel attachment/detachment section 20 includes feeder holding section 21, reel attachment mechanism 22, tape loading mechanism 23, and reel detachment mechanism 24. As illustrated in FIG. 2, feeder holding section 21 is disposed on the second end side (arrow X2 direction) in the first direction and first end side (arrow Y1 direction) in the second direction inside first housing 11. Feeder holding section 21 holds feeder 60 at a work execution position in a vertical posture. As illustrated in FIG. 3, feeder holding section 21 includes bottom plate 21*a*, slot 21*b*, and support plate 21*c*. Slot 21*b* is formed in a groove shape extending along the second direction (arrow Y direction) in bottom plate 21*a*. Feeder 60 is inserted from a first end side (arrow Y1 direction) in the second direction of slot 21*b* toward the second end side (arrow Y2 direction) in the second direction thereof, and is held at the work execution position. Support plate 21*c* is provided to stand up from bottom plate 21*a*, and comes into contact with the side surface of feeder 60 at the work execution position on a second end side (arrow X2 direction) in the first direction. Support plate 21*c* supports a pressing load to the second end side (arrow X2 direction) in the first direction generated when reel 70 is attached to feeder 60.

Feeder 60 is detachably provided on a component mounter. As illustrated in FIG. 3, in feeder 60, reel 70, on which carrier tape 72 is wound, is attached to main body portion 71, and carrier tape 72 is conveyed to supply electronic component 91. An identification code for identifying reel 70 is given to each reel 70. Feeder 60 is formed in a flat box shape. Feeder 60 includes reel holding shaft 61 that protrudes from a side plate at the second end side (arrow X2 direction) in the first direction toward the first end side (arrow X1 direction) in the first direction at a substantially central position as viewed in the first direction (arrow X direction). Reel holding shaft 61 is inserted into a center hole formed at the center of reel 70, and detachably and rotatably holds reel 70.

Figure 4:
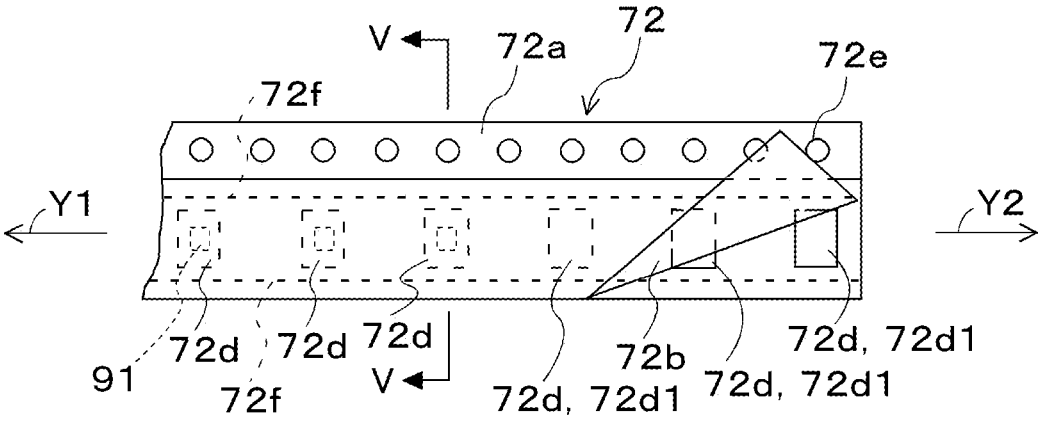
FIG. 4 is a plan view illustrating an example of a carrier tape.
Figure 5:
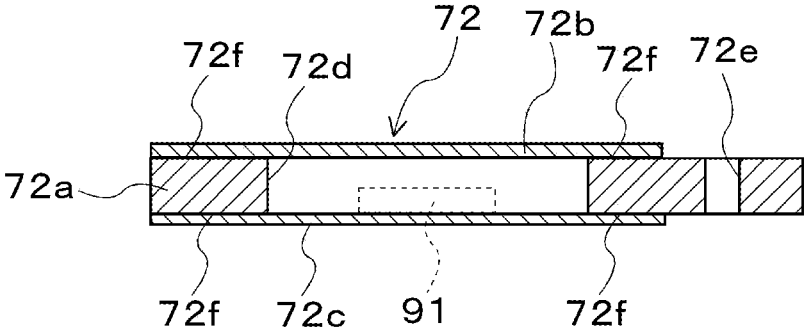
FIG. 5 is a cross-sectional view of the carrier tape in FIG. 4.

As illustrated in FIGS. 4 and 5, carrier tape 72 includes base tape 72*a*, cover tape 72*b*, and bottom tape 72*c*. Base tape 72*a* is a base portion of carrier tape 72, and is provided with multiple accommodation sections 72*d* and multiple feed holes 72*e*. Electronic component 91 is accommodated in each of multiple accommodation sections 72*d*. As illustrated in FIG. 4, a predetermined number (for example, three in FIG. 4) of accommodation sections 72*d* from a tip end side of carrier tape 72 are empty accommodation sections 72*d*1 in which electronic component 91 is not accommodated. Multiple accommodation sections 72*d* are provided at predetermined pitch intervals in a longitudinal direction of carrier tape 72 at the center portion in a width direction of base tape 72*a*.

Each of multiple feed holes 72*e* is a through hole, and is used when carrier tape 72 is conveyed in the conveyance direction (the second end side (arrow Y2 direction) in the second direction). Multiple feed holes 72*e* are provided at a predetermined pitch interval in the longitudinal direction of carrier tape 72 on the first end side in the width direction of base tape 72*a*. Cover tape 72*b* closes accommodation sections 72*d* of base tape 72*a*. Cover tape 72*b* is attached to the upper surfaces of both end portions of base tape 72*a* in the width direction by, for example, adhesive 72*f* or thermocompression bonding. Bottom tape 72*c* is attached to the lower surface of base tape 72*a* by, for example, adhesive 72*f* or thermocompression bonding, and prevents electronic component 91 accommodated in accommodation section 72*d* from falling off.

A central portion of side plate 62 on a first end side (arrow X1 direction) in the first direction of feeder 60 is open in order to facilitate attachment and detachment of reel 70. At least one of the material of carrier tape 72, the width dimension of carrier tape 72, and the width dimension of reel 70 is different among multiple types of reels 70, and there are multiple types of feeders 60 corresponding to multiple types of reels 70. Feeder 60 includes collection position 63, sprocket 64, and a tape release section.

Collection position 63 is provided on a second end side (arrow Y2 direction) in the second direction of the upper surface of feeder 60, and the component mounter collects electronic component 91 at collection position 63. Sprocket 64 is rotatably provided on a first end side (arrow Y1 direction) in the second direction with respect to collection position 63. A teeth portion of sprocket 64 engage with feed hole 72*e* of carrier tape 72. Sprocket 64 is intermittently driven by a drive motor and conveys carrier tape 72 at a constant pitch. The tape release section can release cover tape 72*b* from base tape 72*a* immediately before collection position 63 to take out electronic component 91. After passing through collection position 63, carrier tape 72 is cut by a tape cutting device provided in the component mounter.

An identification code for identifying feeder 60 is given to each of feeders 60. Feeder 60 is provided with a feeder control section. The feeder control section stores the identification code of feeder 60 and the identification code of reel 70, and controls the component supply operation. When feeder 60 is held by feeder holding section 21, the connectors are fitted to each other, and the feeder control section is communicably connected to setup device 10.

Reel attachment mechanism 22 is provided on a first end side (arrow X1 direction) in the first direction of feeder holding section 21. Reel attachment mechanism 22 uses reel transfer mechanism 40 to change reel 70 from a horizontal posture to a vertical posture and attach reel 70 to feeder 60 at the work execution position. Reel attachment mechanism 22 includes pair of guide rails 22*a* and 22*a*, moving table 22*b*, attachment material 22*c*, placement area 22*d*, and temporary placement area 22*e*. Reel attachment mechanism 22 may be configured such that a mechanism that changes reel 70 from the horizontal posture to the vertical posture and a mechanism that attaches reel 70 in the vertical posture to feeder 60 are separated.

Pair of guide rails 22*a* and 22*a* extends along the first direction (arrow X direction) at a substantially central position in the second direction (arrow Y direction) of first housing 11, and is disposed in parallel to be separated from each other. Moving table 22*b* extends along the second direction (arrow Y direction), and is provided to straddle the upper side of pair of guide rails 22*a* and 22*a*. As illustrated in FIGS. 1 and 2, moving table 22*b* moves along pair of guide rails 22*a* and 22*a*, and reciprocates between a standby position provided on the first end side (arrow X1 direction) in the first direction and feeder holding section 21 provided on the second end side (arrow X2 direction) in the first direction.

Attachment material 22*c* is formed in a square bar shape, and is provided to extend upward from moving table 22*b*. Attachment material 22*c* faces reel holding shaft 61 of feeder 60 at the work execution position. Specifically, attachment material 22*c* is provided at a position separated by a predetermined distance from a tip end portion of reel holding shaft 61 toward the first end side (arrow X1 direction) in the first direction. Attachment material 22*c* swings (arrow SW1 in FIG. 1) between an upright posture illustrated in FIGS. 1 and 2 and a horizontal posture in which attachment material 22*c* is tilted toward the second end side (arrow X2 direction) in the first direction around swing shaft 22*c*1 provided on moving table 22*b* side. Collection section 22*c*2 is provided on an end portion on a side different from an end portion of swing shaft 22*c*1 side of attachment material 22*c*. Collection section 22*c*2 detachably collects reel 70. As collection section 22*c*2, a claw portion inserted into the center hole of reel 70, a gripping mechanism that grips a peripheral edge of reel 70, a pickup mechanism that picks up reel 70 using negative pressure, or the like may be used.

Placement area 22*d* is provided on the first end side (arrow X1 direction) in the first direction in pair of guide rails 22*a* and 22*a*. In placement area 22*d*, reel 70 to be attached is placed in a horizontal posture. Temporary placement area 22*e* is provided on pair of guide rails 22*a* and 22*a* on the second end side (arrow X2 direction) in the first direction with respect to placement area 22*d*. In temporary placement area 22*e*, when reel attachment mechanism 22 changes the use order of reels 70, reels 70 are temporarily placed in the horizontal posture and the use order of reels 70 is changed. In temporary placement area 22*e*, an area in which multiple reels 70 can be temporarily placed is secured. Moving table 22*b* and attachment material 22*c* move above placement area 22*d* and temporary placement area 22*e*.

As illustrated in FIG. 2, tape loading mechanism 23 is provided near feeder holding section 21. Tape loading mechanism 23 loads carrier tape 72 in feeder 60 so that carrier tape 72 can be fed. For example, an articulated robot can be used as tape loading mechanism 23. Tape loading mechanism 23 of the embodiment includes articulated arm 23*a*, camera 23*b*, and multiple fingers 23*c*.

Articulated arm 23*a* can perform operations such as rotation and bending of the arm, and can adjust the positions and directions of camera 23*b* and multiple fingers 23*c*. Camera 23*b* is provided at a tip end portion of articulated arm 23*a*. Camera 23*b* captures an image of feeder 60 at the work execution position to detect the position and the state of reel 70 and carrier tape 72. Multiple fingers 23*c* are provided side by side with camera 23*b* at the tip end portion of articulated arm 23*a*. Multiple fingers 23*c* can perform a moving operation, a twisting operation, and the like in addition to the operation of gripping and releasing a work target.

Multiple fingers 23*c* loads carrier tape 72 so that feed hole 72*e* at a tip end portion of carrier tape 72 engages with sprocket 64, and sets carrier tape 72 in a feedable state. Multiple fingers 23*c* facilitate the loading operation of carrier tape 72 by rotating reel 70 around reel holding shaft 61 as necessary. Tape loading mechanism 23 takes a retracted posture in which articulated arm 23*a* is bent not to hinder the attaching and detaching operation of reel 70 in a time period other than the operation time.

Reel detachment mechanism 24 is provided on the first end side (arrow X1 direction) in the first direction of feeder holding section 21, and is disposed above reel attachment mechanism 22. Reel detachment mechanism 24 detaches reel 70 from feeder 60 at the work execution position. Reel detachment mechanism 24 includes guide rail 24*a*, moving table 24*b*, detachment material 24*c*, and retrieval box 24*d*.

Guide rail 24*a* is provided in the vicinity of the ceiling of first housing 11, and is formed to extend along the second direction (arrow Y direction). Moving table 24*b* is formed to extend along the first direction (arrow X direction), and is provided below guide rail 24*a*. As illustrated in FIGS. 1 and 2, moving table 24*b* moves along guide rail 24*a* and reciprocates between feeder holding section 21 and a standby position provided on the second end side (arrow Y2 direction) in the second direction.

Detachment material 24*c* is formed of a thick plate-shaped member longer than moving table 24*b*, and is provided to extend along the first direction (arrow X direction) below moving table 24*b*. Detachment material 24*c* swings (arrow SW2 in FIG. 1) between a horizontal posture illustrated in FIGS. 1 and 2 and a vertical posture in which detachment material 24*c* is tilted downward around swing shaft 24*c*1 provided on the second end side (arrow X2 direction) in the first direction of moving table 24*b*. Collection section 24*c*2 is provided on an end portion on a side different from the end portion on swing shaft 24*c*1 side of detachment material 24*c*. Collection section 24*c*2 detachably collects reel 70. The method of collecting collection section 24*c*2 may be the same as or different from collection section 22*c*2 of reel attachment mechanism 22.

Retrieval box 24*d* is provided to be positioned below detachment material 24*c* when moving table 24*b* is moved to the standby position. Retrieval box 24*d* retrieves multiple detached reels 70. Retrieval box 24*d* is formed in a box shape opening upward. Accordingly, retrieval box 24*d* can retrieve reel 70 that falls when collection section 24*c*2 of detachment material 24*c* releases reel 70.

Reel supply section 30 includes reel holding section 31 that is detachably provided. Pair of guide plates 12*a* and 12*a* extending along the second direction (arrow Y direction) is provided on the first end side (arrow X1 direction) in the first direction and the second end side (arrow X2 direction) in the first direction of the upper surface of base 12. Reel holding section 31 is placed between pair of guide plates 12*a* and 12*a* of base 12. As illustrated in FIG. 2, surfaces of pair of guide plates 12*a* and 12*a* facing each other on the first end side (arrow Y1 direction) in the second direction are formed in a tapered shape, and a separation distance on the first end side (arrow Y1 direction) in the second direction is longer than that on the second end side (arrow Y2 direction) in the second direction. This facilitates the work of inserting reel holding section 31 toward base 12 from the first end side (arrow Y1 direction) in the second direction.

Reel holding section 31 stacks and holds multiple reels 70 in a horizontal posture. Reel 70 is not limited to an unused reel, and may be a reel in use in which carrier tape 72 has been used halfway. Reel holding section 31 includes circular plate-shaped holding plate 31*a* provided horizontally, and round rod-shaped holding shaft 31*b* provided upward from the center of holding plate 31*a* and penetrating through the center hole of reel 70. Accordingly, reel holding section 31 can hold multiple reels 70 in a state where holding shaft 31*b* penetrates through the center holes of multiple reels 70 even when reels 70 having at least one of different diameter and different width dimension coexist, and reels 70 can be easily taken out. Identification code 31*c* is given to an upper surface of holding plate 31*a*. Identification code 31*c* includes information for specifying reel holding section 31.

For example, the worker procures multiple reels 70 based on work instruction data, and performs a stacking work of stacking multiple reels 70 on reel holding section 31. The work instruction data indicates a work content of the setup work performed by setup device 10. That is, in the work instruction data, type information of multiple reels 70 required with the progress of the production of the board product by the component mounter is associated with type information of multiple feeders 60 applicable to reels 70. A known automated guided vehicle or the like may also be used to convey multiple reels 70.

Reel transfer mechanism 40 is provided on plate base 12*b* extending from a bottom portion of base 12 to a second end side (arrow X2 direction) in the first direction. Reel transfer mechanism 40 includes support column 41, arm 42, and collection section 43. Support column 41 stands upward in the vertical direction on the second end side (arrow Y2 direction) in the second direction of plate base 12*b*. Arm 42 is provided to be liftable and lowerable with respect to support column 41. Further, arm 42 is provided to be rotatable on a horizontal plane around rotation shaft 44 close to support column 41.

Collection section 43 is provided to be extendable and contractible with respect to arm 42. Collection section 43 detachably collects reel 70. The method of collecting collection section 43 may be the same as or different from the method of collecting collection section 22*c*2 of reel attachment mechanism 22 and collection section 24*c*2 of reel detachment mechanism 24. Collection section 43 is provided with a code reader. The code reader reads identification code 31*c* of reel holding section 31. Further, the code reader can read the identification code of uppermost reel 70.

Reel transfer mechanism 40 functions as a part of reel attachment mechanism 22. Specifically, reel transfer mechanism 40 takes out reel 70 from reel holding section 31 by driving arm 42 and collection section 43. Further, reel transfer mechanism 40 places taken out reel 70 in placement area 22*d* or temporary placement area 22*e* in the state of the horizontal posture by driving arm 42 and collection section 43. Reel transfer mechanism 40 subsequently uses multiple reels 70 stacked on reel holding section 31 from the uppermost.

Feeder supply section 50 includes feeder accommodation section 51 that is detachably provided and feeder conveyance section 52. As illustrated in FIG. 2, storage space 13*a* in the upper portion of second housing 13 is open on the first end side (arrow Y1 direction) in the second direction, and can store multiple (for example, two in FIG. 2) feeder accommodation sections 51 arranged along the first direction (arrow X direction). As illustrated in FIG. 1, multiple roller conveyors 13*b* extending along the first direction (arrow X direction) are provided on a bottom surface defining storage space 13*a*, so that a storage operation of feeder accommodation section 51 is facilitated.

Feeder accommodation section 51 is formed in a box shape whose first end side (arrow Y1 direction) in the second direction is opened. Multiple slots having the same shape as slot 21*b* of feeder holding section 21 are formed on the bottom surface of feeder accommodation section 51. Feeder accommodation section 51 can accommodate multiple feeders 60 in a vertical posture arranged along the first direction (arrow X direction). When multiple feeders 60 are accommodated in feeder accommodation section 51 and feeder accommodation section 51 is properly stored in storage space 13*a*, the connectors of feeder 60 and feeder accommodation section 51 are fitted to each other, and multiple feeder control sections are communicably connected to setup device 10.

An identification code for identifying feeder accommodation section 51 is given to feeder accommodation section 51. For example, the worker procures multiple feeders 60 to be used based on the work instruction data, and performs the accommodation work of accommodating feeders 60 in feeder accommodation section 51. The number of feeder accommodation sections 51 that can be accommodated in storage space 13*a* may be one or three or more. A known automated guided vehicle or the like can also be used to convey multiple feeders 60.

Guide rail 13*c* is provided in a lower portion on the first end side (arrow Y1 direction) in the second direction of storage space 13*a* of second housing 13. Guide rail 13*c* is provided in storage space 13*a* over substantially the entire first direction (arrow X direction), and is provided to extend to the first end side (arrow Y1 direction) in the second direction of feeder holding section 21. Guide rail 13*c* is provided with feeder conveyance section 52. Feeder conveyance section 52 moves along guide rail 13*c* and reciprocates between feeder accommodation section 51 and feeder holding section 21.

Feeder conveyance section 52 is formed in a box shape having an opening portion on the second end side (arrow Y2 direction) in the second direction. Feeder conveyance section 52 includes a built-in space that temporarily incorporates feeder 60, and a feeder operation mechanism that conveys feeder 60 into the built-in space through the opening portion and conveys feeder 60 out of the built-in space. Accordingly, feeder conveyance section 52 can convey feeder 60 out of feeder accommodation section 51 and feeder holding section 21, and can convey feeder 60 into feeder accommodation section 51 and feeder holding section 21. An openable and closable safety fence is provided on the first end side (arrow Y1 direction) in the second direction of reel supply section 30 and feeder supply section 50, and the approach of the worker to reel supply section 30 and feeder supply section 50 is suppressed.

1-2. Control Example of Setup Device 10

Figure 6:
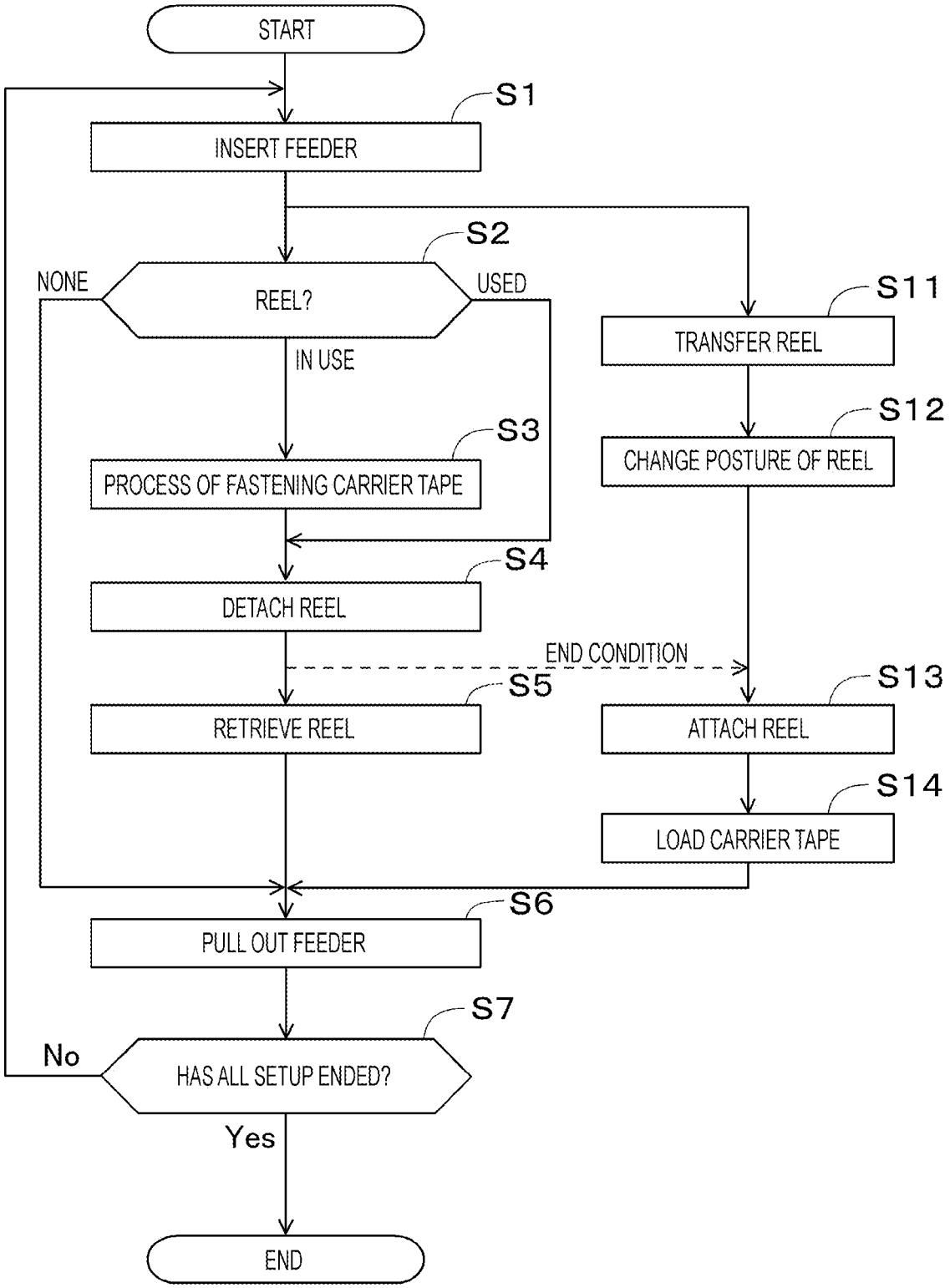
FIG. 6 is a flowchart illustrating an example of a control procedure by the setup device.

Setup device 10 causes feeder conveyance section 52 to convey feeder 60 corresponding to uppermost reel 70 of reel holding section 31 (step S1 illustrated in FIG. 6). Feeder conveyance section 52 pulls out and incorporates feeder 60 from feeder accommodation section 51, moves to feeder holding section 21, and inserts incorporated feeder 60 into feeder holding section 21. Accordingly, feeder 60 is held at the work execution position, and the identification code of feeder 60 is read.

When there is no feeder 60 applicable to uppermost reel 70 of reel holding section 31, reel 70 is placed in temporary placement area 22*e* by reel transfer mechanism 40. The above-described placement is repeated until applicable feeder 60 is present, and feeder 60 corresponding to uppermost reel 70 of reel holding section 31 is inserted into feeder holding section 21. After the control illustrated in step S1, in setup device 10, a first-series control illustrated in steps S2 to S5 and a second-series control illustrated in steps S11 to S14 are executed in parallel.

In the first-series control, setup device 10 checks the state of reel 70 based on the read identification code of feeder 60 or the read identification code of reel 70, and changes the control according to the state of reel 70 (step S2). Specifically, when feeder 60 is used in the component mounter in advance, there is a possibility that reel 70 in use in which carrier tape 72 has been used halfway is provided in feeder 60. In this case, tape loading mechanism 23 performs a fastening process of fixing the tip end portion of carrier tape 72 with a tape or the like to suppress slack of carrier tape 72 (step S3). At this time, tape loading mechanism 23 can wind carrier tape 72 around reel 70 as necessary. Thereafter, tape loading mechanism 23 takes a retracted posture in which articulated arm 23*a* is bent.

Next, reel detachment mechanism 24 detaches reel 70 from feeder 60 (step S4). Specifically, moving table 24*b* moves from the standby position to feeder holding section 21. Then, when detachment material 24*c* is swung from the horizontal posture to the vertical posture, collection section 24*c*2 comes into contact with reel 70 and collects reel 70. Then, when detachment material 24*c* returns from the vertical posture to the horizontal posture, collection section 24*c*2 pulls out reel 70 from reel holding shaft 61 and holds reel 70 in the horizontal posture. At this time, setup device 10 deletes the identification code of reel 70 from the storage section of the feeder control section of feeder 60. Further, setup device 10 transmits the identification code of feeder 60, from which reel 70 has been detached, to a higher-level management device. At this time, setup device 10 may transmit the identification code of detached reel 70 together with the identification code of feeder 60 to the higher-level management device.

Next, reel detachment mechanism 24 retrieves reel 70 (step S5). Specifically, first, moving table 24*b* moves from feeder holding section 21 to the standby position. Then, collection section 24*c*2 releases reel 70. Thus, released reel 70 falls into retrieval box 24*d* and is retrieved. When reel 70 is retrieved, the first-series control is in a standby state until the second-series control ends.

There is a possibility that feeder 60 is provided with used reel 70 in which all of carrier tape 72 has been used (step S2). In this case, in the first-series control, the control illustrated in step S3 is omitted, and the controls illustrated in step S4 and step S5 are executed. There is a possibility that feeder 60 is not provided with reel 70 (step S2). In this case, in the first-series control, the controls illustrated in steps S3 to S5 are omitted.

In the second-series control, reel transfer mechanism 40 collects uppermost reel 70 of reel holding section 31 using collection section 43, and places reel 70 in placement area 22*d* (step S11). Then, reel transfer mechanism 40 returns collection section 43 to above reel holding section 31. When there is no applicable feeder 60, reel transfer mechanism 40 places reel 70 in temporary placement area 22*e*.

Next, reel attachment mechanism 22 changes the posture of reel 70 in placement area 22*d* (step S12). Specifically, first, attachment material 22*c* is changed from the upright posture to the horizontal posture, and collection section 22*c*2 comes into contact with reel 70 to collect reel 70. Then, attachment material 22*c* is returned from the horizontal posture to the upright posture, and collection section 22*c*2 changes reel 70 from the horizontal posture to the vertical posture and holds reel 70. When reel 70 in temporary placement area 22*e* is used, moving table 22*b* moves to the second end side (arrow X2 direction) in the first direction by a predetermined distance before attachment material 22*c* shifts from the upright posture to the horizontal posture. The second-series control is in a standby state until an end condition indicating the completion of the control of step S4 of the first series is satisfied. This avoids interference between reel attachment mechanism 22 and reel detachment mechanism 24.

When the end condition described above is satisfied, reel attachment mechanism 22 attaches reel 70 on feeder 60 (step S13). Specifically, in a state where collection section 22*c*2 holds reel 70 in the vertical posture, moving table 22*b* moves to feeder holding section 21. Accordingly, reel 70 moves toward reel holding shaft 61 and is attached to reel holding shaft 61. The movement of moving table 22*b* can be performed simultaneously with the movement of moving table 24*b* to the standby position.

When the attachment of reel 70 ends, setup device 10 stores the identification code of reel 70 in the feeder control section of feeder 60 to which reel 70 is attached. Further, setup device 10 transmits the identification code of feeder 60 and the identification code of reel 70 mounted on feeder 60 to the higher-level management device in association with each other. Moving table 22*b* returns to the standby position. Next, tape loading mechanism 23 loads carrier tape 72 until feed hole 72*e* of carrier tape 72 engages with the teeth portion of sprocket 64 (step S14).

When the first-series control and the second-series control end, feeder conveyance section 52 pulls out feeder 60 from feeder holding section 21, incorporates feeder 60 therein, moves feeder 60 to feeder accommodation section 51, and inserts incorporated feeder 60 into feeder accommodation section 51 (step S6). Thus, the setup work for one feeder 60 ends. Setup device 10 determines whether the setup work for all feeders 60 has ended (step S7). When the setup work for all feeders 60 has ended (Yes in step S7), the control by setup device 10 temporarily ends. When the setup work for all feeders 60 has not ended (No in step S7), the control by setup device 10 returns to the control illustrated in Step S1, and the control described above is repeated until the setup work for all feeders 60 ends.

When the control by setup device 10 ends, for example, the worker conveys feeder accommodation section 51 accommodating feeders 60 that have been set up to the component mounter, and performs the setup change of feeders 60. When reel 70 is placed in temporary placement area 22*e*, reel 70 becomes usable when the worker accommodates feeder 60 applicable to reel 70 in feeder accommodation section 51. Further, reel 70 left unused in temporary placement area 22*e* is returned to reel holding section 31 by reel transfer mechanism 40 and retrieved by the worker. Further, the above-described conveyance work by the worker can also be automated using a known automated guided vehicle or the like.

1-3. Configuration Example of Tape Releasing Device 80

Figure 7:
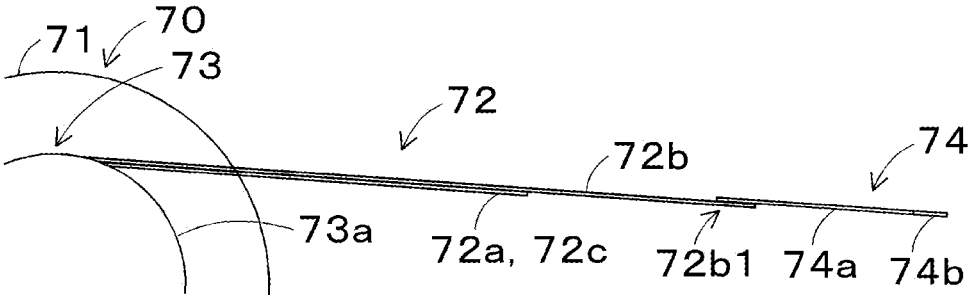
FIG. 7 is a schematic view illustrating an example of a tip end portion of the carrier tape.

As illustrated in FIG. 3, carrier tape 72 is spirally wound around reel 70. As illustrated in FIG. 7, for example, the tip end side of carrier tape 72 of unused reel 70 is formed such that cover tape 72*b* protrudes from base tape 72*a*. Tip end portion 72*b*1 of cover tape 72*b* and outer peripheral portion 73*a* of spiral tape 73 are fixed by fixing tape 74.

FIG. 7 is a schematic view of reel 70 as viewed in the rotation axis direction, and illustrates a state, in which fixing tape 74 has been released from outer peripheral portion 73*a* of spiral tape 73 and the tip end side of carrier tape 72 is extended, for convenience of description. As described above, with respect to reel 70 in use, a process of fastening carrier tape 72 is performed. In this case, similarly to unused reel 70, the tip end side of carrier tape 72 can be fixed by fixing tape 74.

As described above, when reel 70 in which the tip end side of carrier tape 72 is fixed by fixing tape 74 is set in feeder 60, it is necessary to release fixing tape 74. When a worker performs the release of fixing tape 74, the number of work steps of the worker increases. Here, in the embodiment, tape releasing device 80 is provided. Tape releasing device 80 releases fixing tape 74 of reel 70.

Figure 8:
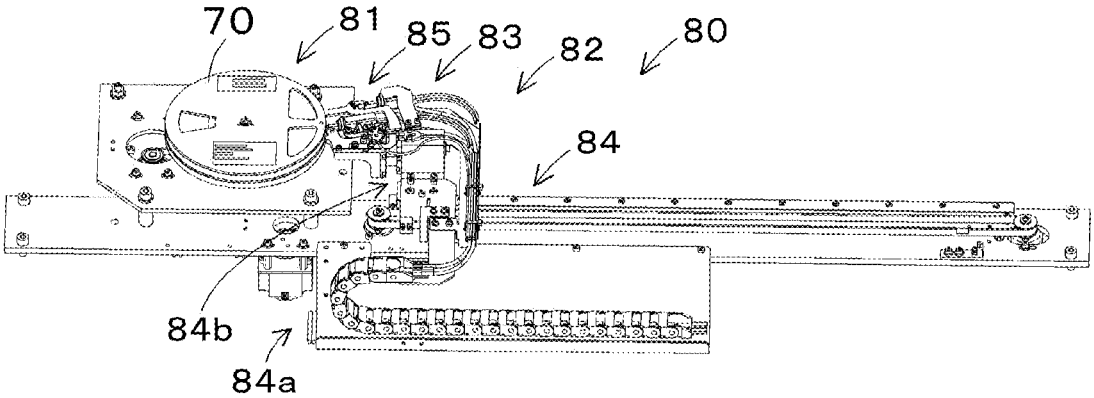
FIG. 8 is a perspective view illustrating an example of a tape releasing device.

Specifically, tape releasing device 80 includes reel support section 81 and release section 82. Release section 82 may include gripping mechanism 83. Release section 82 may also include separation mechanism 84. Tape releasing device 80 may also include detection section 85. As illustrated in FIG. 8, tape releasing device 80 of the embodiment includes reel support section 81, release section 82, and detection section 85. Release section 82 includes gripping mechanism 83 and separation mechanism 84. Tape releasing device 80 of the embodiment executes control according to the flowchart illustrated in FIG. 9.

1-3-1. Reel Support Section 81

Reel support section 81 supports reel 70 on which outer peripheral portion 73*a* of spiral tape 73, on which carrier tape 72 is spirally wound, and tip end portion 72*b*1 of cover tape 72*b* are fixed by first fixing tape 74. As described above, in carrier tape 72, cover tape 72*b* that closes accommodation section 72*d* is attached to base tape 72*a* provided with accommodation section 72*d* that accommodates electronic component 91.

Figure 10:
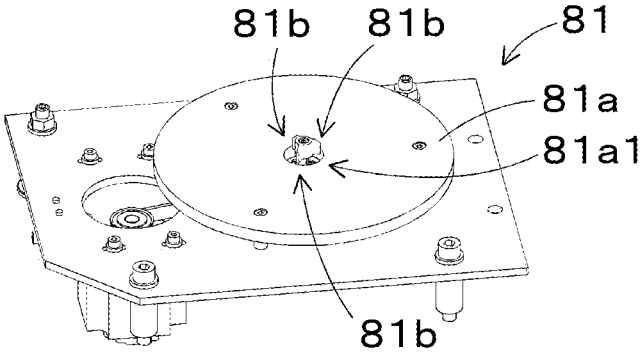
FIG. 10 is a perspective view illustrating an example of a reel support section.
Figure 11:
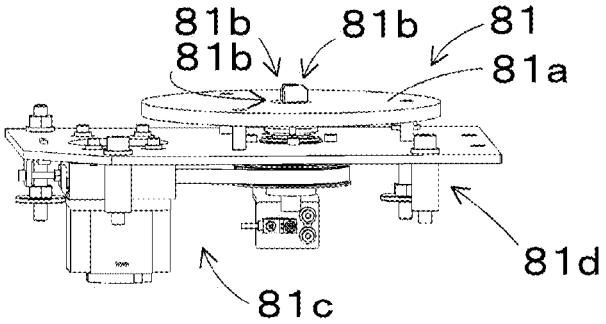
FIG. 11 is a side view of the reel support section in FIG. 10.

Reel support section 81 need only store reel 70 described above, and may take various configurations. For example, reel support section 81 rotatably supports reel 70. As illustrated in FIGS. 10 and 11, reel support section 81 includes placement section 81*a*, multiple (for example, three) claw portions 81*b*, drive section 81*c*, and reel detection section 81*d*. Placement section 81*a* is formed in a circular plate shape equivalent to the diameter of reel 70, and reel 70 described above is placed.

Figure 12:
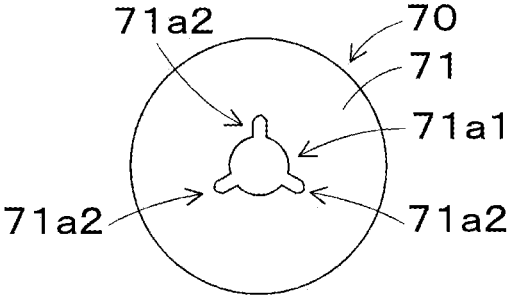
FIG. 12 is a plan view illustrating an example of a rear surface of a reel.
Figure 13:
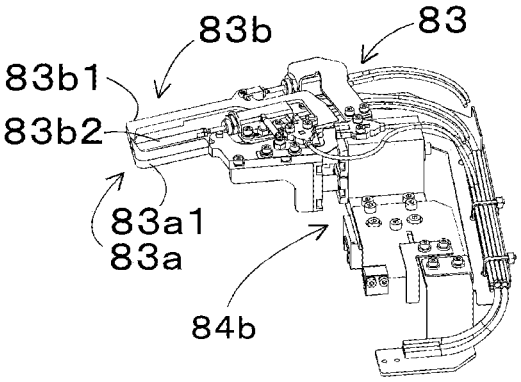
FIG. 13 is a perspective view illustrating an example of a gripping mechanism.

Placement section side hole portion 81*a*1 is formed in the center of placement section 81*a* such that multiple (three) claw portions 81*b* can protrude. Placement section side hole portion 81*a*1 is formed to be slightly larger than reel side hole portion 71*a*1 formed in the center of main body portion 71 of reel 70. As illustrated in FIG. 12, multiple (for example, three) groove portions 71*a*2 extending radially from the rotation axis (the center of main body portion 71) of reel 70 are formed in reel side hole portion 71*a*1.

Multiple (three) groove portions 71*a*2 are disposed at equal intervals (in this case, at positions rotated by 120° each) as viewed in the rotation axis direction of reel 70. Multiple (three) claw portions 81*b* are provided in accordance with the disposition of multiple (three) groove portions 71*a*2. Accordingly, when reel 70 is placed on placement section 81*a*, multiple (three) claw portions 81*b* can be fitted to multiple (three) groove portions 71*a*2.

Multiple (three) claw portions 81*b* are connected to the drive shaft of drive section 81*c*. Drive section 81*c* need only rotate the drive shaft, and may take various configurations. In the embodiment, a known belt driving device is used for drive section 81*c*. Drive section 81*c* rotates multiple (three) claw portions 81*b* connected to the drive shaft by rotating the drive shaft. When multiple (three) claw portions 81*b* rotate, reel 70 placed on placement section 81*a* rotates.

Reel detection section 81*d* detects whether reel 70 is appropriately placed on placement section 81*a*. When reel 70 is appropriately placed on placement section 81*a*, multiple (three) claw portions 81*b* are fitted to multiple (three) groove portions 71*a*2. Conversely, when reel 70 is not appropriately placed on placement section 81*a*, the fitting described above is not sufficient, and reel 70 is lifted from placement section 81*a*. Reel detection section 81*d* can detect the lifting described above.

In the embodiment, reel detection section 81*d* includes a detection device positioned at a predetermined distance above from the height position of reel 70 that is appropriately placed on placement section 81*a*. For example, the detection device emits detection light in the horizontal direction toward the upper side of reel 70. When reel 70 is appropriately placed on placement section 81*a*, the detection light is not blocked, and reel detection section 81*d* detects that reel 70 is appropriately placed on placement section 81*a* (there is no lifting described above). Conversely, when reel 70 is not appropriately placed on placement section 81*a*, the detection light is blocked, and reel detection section 81*d* detects that reel 70 is not appropriately placed on placement section 81*a* (there is the lifting described above). Reel detection section 81*d* can also check the front and back of reel 70 by reading the identification code attached to reel 70.

1-3-2. Release Section 82, Gripping Mechanism 83, Separation Mechanism 84, and Detection Section 85

Release section 82 releases fixing tape 74 of reel 70 supported by reel support section 81. Release section 82 need only release fixing tape 74, and may take various configurations. In the embodiment, release section 82 includes gripping mechanism 83 and separation mechanism 84. Tape releasing device 80 includes detection section 85. Tape releasing device 80 can assume any combination of reel support section 81, release section 82 (gripping mechanism 83 and separation mechanism 84), and detection section 85, and the details described in the present description herein can be applied as appropriate.

When an adhesive is provided over the entire surface of fixing tape 74 on the side fixed to outer peripheral portion 73*a* of spiral tape 73, it is difficult to release fixing tape 74. Therefore, as illustrated in FIG. 7, fixing tape 74 includes adhesive portion 74*a* and non-adhesive portion 74*b*. Adhesive portion 74*a* is a portion where an adhesive is provided. The adhesive is provided on a portion on the base end side of fixing tape 74 on the surface of fixing tape 74 on the side fixed to outer peripheral portion 73*a* of spiral tape 73.

Adhesive portion 74*a* fixes tip end portion 72*b*1 of cover tape 72*b* and fixing tape 74. Adhesive portion 74*a* fixes outer peripheral portion 73*a* of spiral tape 73 and fixing tape 74. Non-adhesive portion 74*b* is a portion on the tip end side of fixing tape 74, and is a portion where the adhesive for fixing tape 74 and outer peripheral portion 73*a* of spiral tape 73 is not provided. Since non-adhesive portion 74*b* is not provided with an adhesive on the surface of fixing tape 74, which is on a side to be fixed to outer peripheral portion 73*a* of spiral tape 73, non-adhesive portion 74*b* is not fixed to outer peripheral portion 73*a* of spiral tape 73 and is thus grippable.

Here, gripping mechanism 83 grips non-adhesive portion 74*b*. Gripping mechanism 83 need only grip non-adhesive portion 74*b*, and may take various configurations. In the embodiment, as illustrated in FIGS. 13 to 18, gripping mechanism 83 includes first gripping mechanism 83*a* and second gripping mechanism 83*b*. First gripping mechanism 83*a* includes first claw portion 83*al* that is insertable between outer peripheral portion 73*a* of spiral tape 73 and non-adhesive portion 74*b*. Second gripping mechanism 83*b* grips non-adhesive portion 74*b* in cooperation with first gripping mechanism 83*a*.

Second gripping mechanism 83*b* need only grip non-adhesive portion 74*b* in cooperation with first gripping mechanism 83*a*, and may take various configurations. For example, second gripping mechanism 83*b* may include second claw portion 83*b*1. Second claw portion 83*b*1 grips non-adhesive portion 74*b* in cooperation with first claw portion 83*a*1 in a state where first claw portion 83*a*1 is inserted between outer peripheral portion 73*a* of spiral tape 73 and non-adhesive portion 74*b*. Specifically, the tip end portion of first claw portion 83*a*1 and the tip end portion of second claw portion 83*b*1 protrude in opposing directions, and non-adhesive portion 74*b* is gripped between the tip end portion of first claw portion 83*a*1 and the tip end portion of second claw portion 83*b*1, so that non-adhesive portion 74*b* is gripped.

The embodiment described above is suitable for a case where fixing tape 74 is made of a material that is relatively difficult to bend, such as a resin tape. Fixing tape 74 includes a tape made of a material that is relatively easy to bend, such as a paper tape. In this case, non-adhesive portion 74*b* of fixing tape 74 may lift up, making it difficult for first claw portion 83*a*1 and second claw portion 83*b*1 to grip non-adhesive portion 74*b*. Therefore, second gripping mechanism 83*b* may include second claw portion 83*b*1 and pressing section 83*b*2.

In the embodiment described above, second claw portion 83*b*1 places non-adhesive portion 74*b* on first claw portion 83*a*1 in a state where first claw portion 83*a*1 is inserted between outer peripheral portion 73*a* of spiral tape 73 and non-adhesive portion 74*b*. Pressing section 83*b*2 presses non-adhesive portion 74*b* in a state where non-adhesive portion 74*b* is placed on first claw portion 83*a*1 by second claw portion 83*b*1. Pressing section 83*b*2 need only press non-adhesive portion 74*b*, and may take various configurations. In the embodiment, pressing section 83*b*2 is formed in a rod shape. In this embodiment, non-adhesive portion 74*b* is gripped by first claw portion 83*a*1 and pressing section 83*b*2.

Detection section 85 detects non-adhesive portion 74*b*. Detection section 85 need only detect non-adhesive portion 74*b*, and may take various configurations. For example, when the same number of electronic components 91 are accommodated in reel 70, the diameter of spiral tape 73 varies depending on the thickness of electronic components 91. Specifically, as the thickness of electronic component 91 increases, the diameter of spiral tape 73 increases. When the diameter of spiral tape 73 varies, the distance from gripping mechanism 83 to outer peripheral portion 73*a* of spiral tape 73 in which non-adhesive portion 74*b* is present also varies. Therefore, it is preferable for detection section 85 to include outer peripheral detection section 85*s* that detects outer peripheral portion 73*a* of spiral tape 73. In this case, detection section 85 can detect non-adhesive portion 74*b* with reference to outer peripheral portion 73*a* of spiral tape 73 detected by outer peripheral detection section 85*s*.

Figure 9:
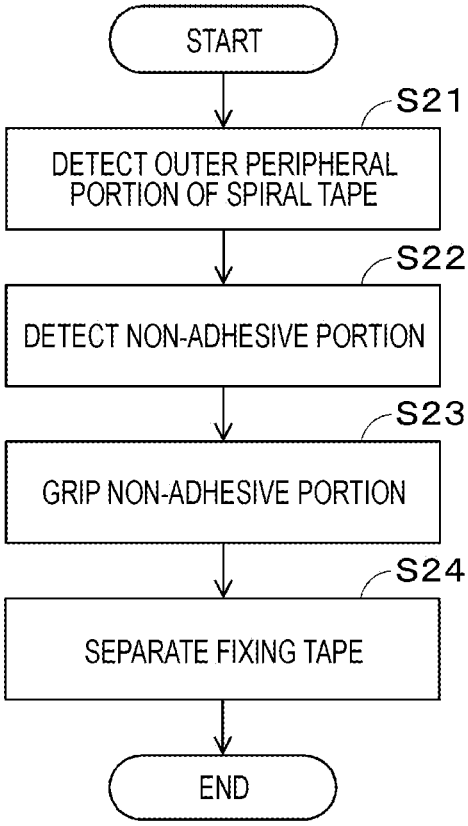
FIG. 9 is a flowchart illustrating an example of a control procedure by the tape releasing device.

For example, outer peripheral detection section 85*s* detects outer peripheral portion 73*a* of spiral tape 73 by bringing gripping mechanism 83 capable of gripping non-adhesive portion 74*b* into contact with outer peripheral portion 73*a* of spiral tape 73 (step S21 illustrated in FIG. 9). Then, detection section 85 detects non-adhesive portion 74*b* by relatively moving gripping mechanism 83 along outer peripheral portion 73*a* of spiral tape 73 detected by outer peripheral detection section 85*s* (step S22). As illustrated in FIGS. 13 to 18, in the embodiment, gripping mechanism 83 includes first claw portion 83*a*1. Outer peripheral detection section 85*s* includes first dog 85*a* and first sensor 85*b*.

Figure 14:
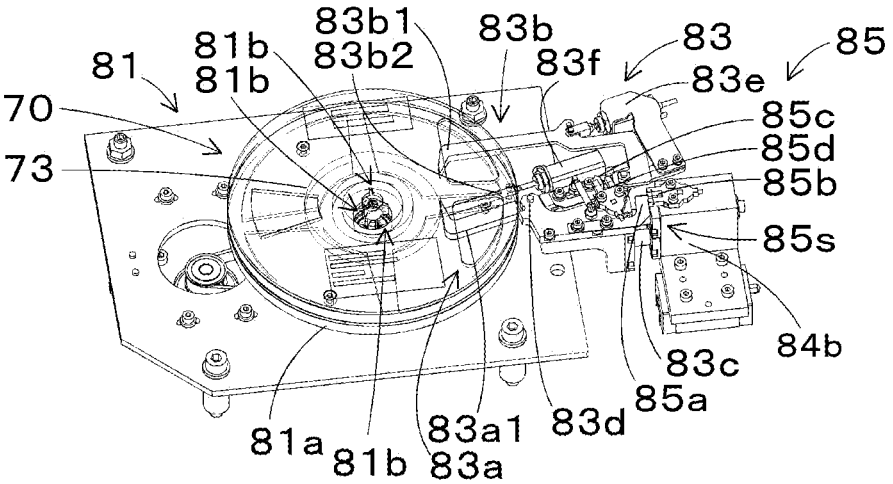
FIG. 14 is a transparent view of the reel illustrating an example of a state in which a first claw portion has reached an outer peripheral portion of a spiral tape.
Figure 15:
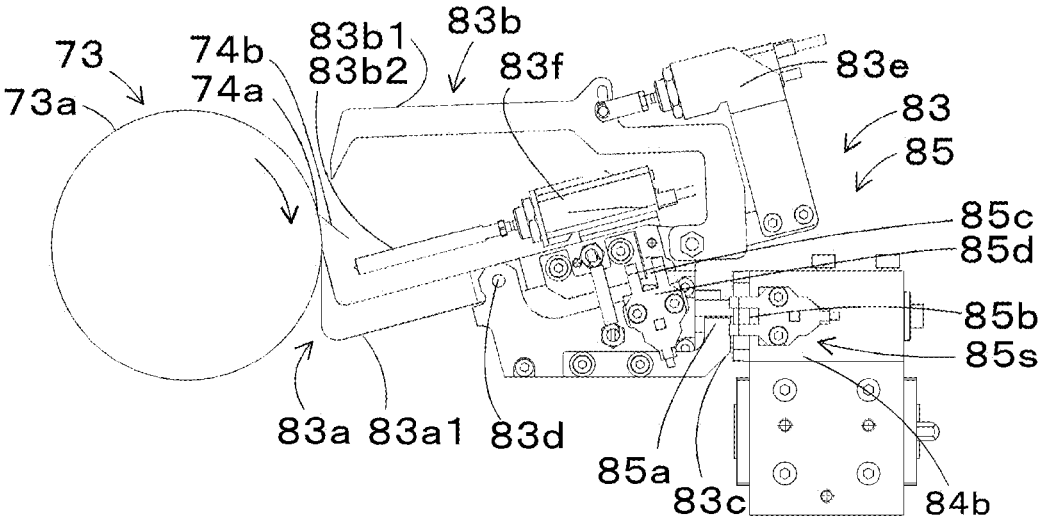
FIG. 15 is a schematic view illustrating a positional relationship between the spiral tape in FIG. 14, and the gripping mechanism and a detection section.

First dog 85*a* is displaced when first claw portion 83*a*1 moves toward outer peripheral portion 73*a* of spiral tape 73 and reaches outer peripheral portion 73*a* of spiral tape 73. First sensor 85*b* detects that first claw portion 83*a*1 has reached outer peripheral portion 73*a* of spiral tape 73 by the displacement of first dog 85*a*. For example, outer peripheral detection section 85*s* moves gripping mechanism 83 toward reel 70 by using drive section 84*a* of separation mechanism 84 illustrated in FIG. 8. As illustrated in FIGS. 14 and 15, gripping mechanism 83 is supported by moving body 84*b* of separation mechanism 84 via elastic member 83*c*. Elastic member 83*c* is formed by, for example, a spring.

When gripping mechanism 83 moves toward outer peripheral portion 73*a* of spiral tape 73 together with moving body 84*b*, gripping mechanism 83 reaches outer peripheral portion 73*a* of spiral tape 73, and moving body 84*b* further moves, gripping mechanism 83 relatively displaces with respect to moving body 84*b*. More specifically, when moving body 84*b* further moves toward spiral tape 73 after first claw portion 83*a*1 has reached outer peripheral portion 73*a* of spiral tape 73, elastic member 83*c* contracts against the elastic force, and gripping mechanism 83 relatively displaces with respect to moving body 84*b*. When elastic member 83*c* contracts, first dog 85*a* provided in gripping mechanism 83 moves toward first sensor 85*b* provided in moving body 84*b* and blocks the detection light of first sensor 85*b*. Thus, outer peripheral detection section 85*s* detects that first claw portion 83*a*1 has reached outer peripheral portion 73*a* of spiral tape 73.

As described above, detection section 85 includes first dog 85*a* and first sensor 85*b*. Detection section 85 includes second dog 85*c* and second sensor 85*d*. Second dog 85*c* is displaced when, in a state where first claw portion 83*al* has reached outer peripheral portion 73*a* of spiral tape 73, reel 70 is rotated by reel support section 81 so that first claw portion 83*a*1 is inserted between outer peripheral portion 73*a* of spiral tape 73 and non-adhesive portion 74*b*, and reaches adhesive portion 74*a*. Second sensor 85*d* detects that first claw portion 83*al* has reached adhesive portion 74*a* of fixing tape 74 by the displacement of second dog 85*c*.

Figure 16:
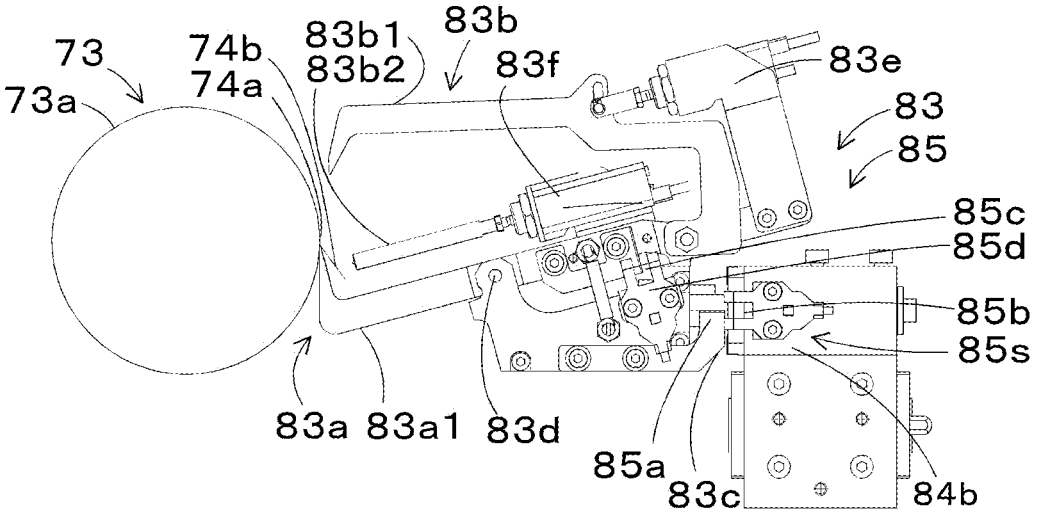
FIG. 16 is a schematic view illustrating a state in which the first claw portion has reached an adhesive portion of the fixing tape.

Specifically, in the state illustrated in FIG. 15, when reel 70 is rotated by reel support section 81, the state illustrated in FIG. 16 is obtained. When reel 70 further rotates after first claw portion 83*a*1 has reached adhesive portion 74*a*, first claw portion 83*a*1 rotates counterclockwise around rotating section 83*d* in the plane view of FIG. 16. Due to the rotation of first claw portion 83*a*1, second dog 85*c* provided in first claw portion 83*a*1 moves away from second sensor 85*d*, and the detection light of second sensor 85*d* is no longer blocked. Thus, detection section 85 detects that first claw portion 83*a*1 has reached adhesive portion 74*a* of fixing tape 74, and detects non-adhesive portion 74*b* on the tip end side with respect to adhesive portion 74*a*.

Figure 17:
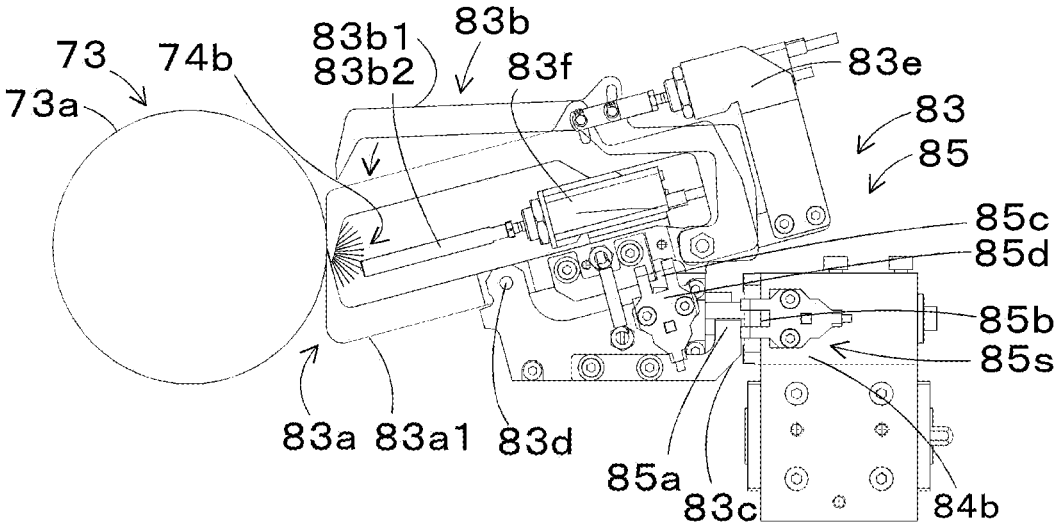
FIG. 17 is a schematic view illustrating an example of an operation of a second claw portion.

In the embodiment, first gripping mechanism 83*a* includes first claw portion 83*a*1. Second gripping mechanism 83*b* includes second gripping mechanism 83*b* and pressing section 83*b*2. Gripping mechanism 83 grips non-adhesive portion 74*b* using first claw portion 83*a*1, second claw portion 83*b*1, and pressing section 83*b*2 (step S23 illustrated in FIG. 9). As illustrated in FIG. 17, second gripping mechanism 83*b* uses second claw portion 83*b*1 to place non-adhesive portion 74*b* on first claw portion 83*a*1 in a state where first claw portion 83*a*1 is inserted between outer peripheral portion 73*a* of spiral tape 73 and non-adhesive portion 74*b*. Specifically, second gripping mechanism 83*b*, for example, uses linear motion mechanism 83*e*, such as a cylinder, to push out and rotate second claw portion 83*b*1. Thus, non-adhesive portion 74*b* is placed on first claw portion 83*a*1.

Figure 18:
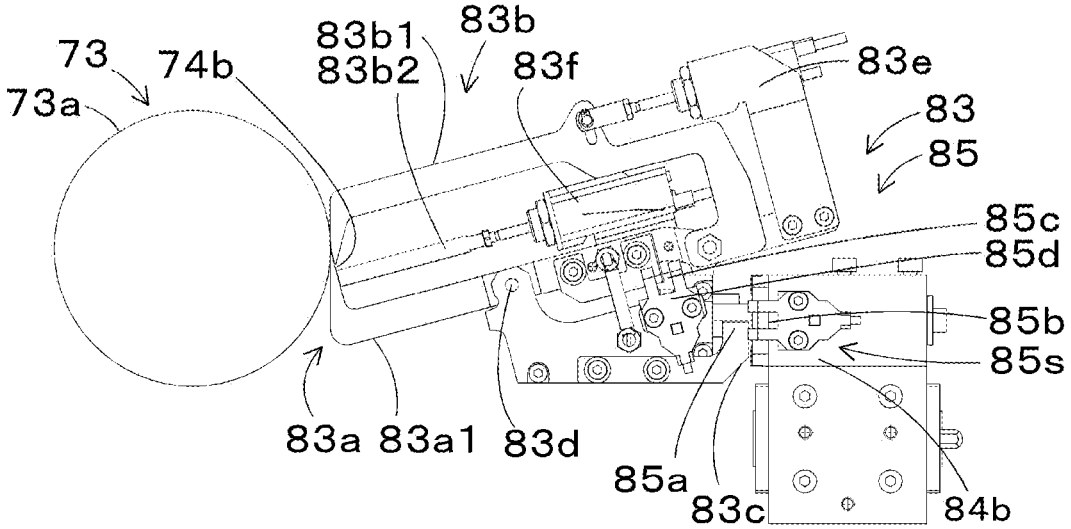
FIG. 18 is a schematic view illustrating an example of a state in which a non-adhesive portion of the fixing tape is gripped.

Next, as illustrated in FIG. 18, second gripping mechanism 83*b* presses non-adhesive portion 74*b* using pressing section 83*b*2 in a state where non-adhesive portion 74*b* is placed on first claw portion 83*a*1 by second claw portion 83*b*1. Specifically, second gripping mechanism 83*b*, for example, uses linear motion mechanism 83*f*, such as a cylinder, to push pressing section 83*b*2. Thus, non-adhesive portion 74*b* is gripped by first claw portion 83*a*1 and pressing section 83*b*2.

Figure 19:
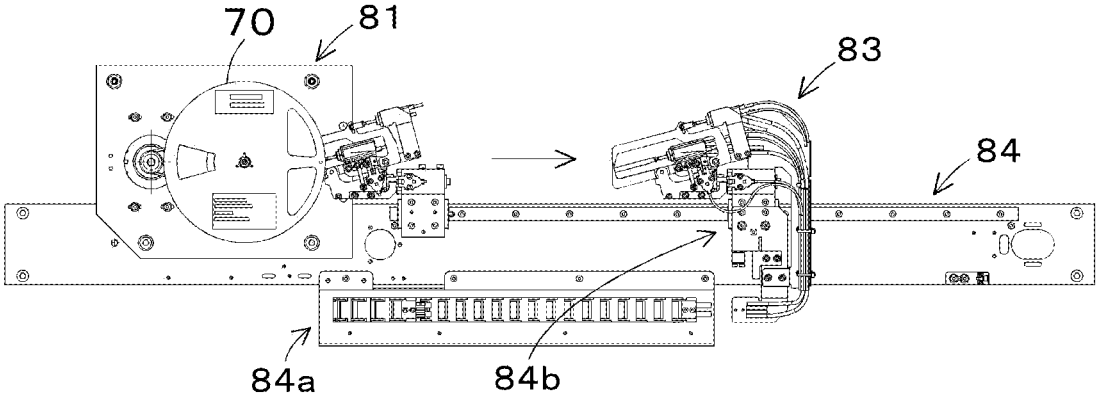
FIG. 19 is a schematic view illustrating a movement of the gripping mechanism by a separation mechanism.

Separation mechanism 84 separates fixing tape 74 from cover tape 72*b* (step S24 illustrated in FIG. 9). Separation mechanism 84 need only separate fixing tape 74 from cover tape 72*b*, and may take various configurations. As illustrated in FIG. 19, in the embodiment, separation mechanism 84 moves gripping mechanism 83 in a direction away from reel 70 in a state where gripping mechanism 83 grips non-adhesive portion 74*b*, and separates fixing tape 74 from cover tape 72*b*.

Specifically, separation mechanism 84 includes drive section 84*a*. Drive section 84*a* need only move gripping mechanism 83 as described above, and may take various configurations. In the embodiment, a known belt driving device is used as drive section 84*a*. Drive section 84*a* can move gripping mechanism 83 in a direction away from reel 70 (right direction in the plane view of FIG. 19). Drive section 84*a* can also move gripping mechanism 83 in a direction toward reel 70 (left direction in the plane view of FIG. 19).

Reel support section 81 rotatably supports reel 70. When reel 70 is placed on placement section 81*a*, multiple (three) claw portions 81*b* are fitted to multiple (three) groove portions 71*a*2. In addition, multiple (three) claw portions 81*b* are connected to the drive shaft of drive section 81*c*. Therefore, when separation mechanism 84 moves gripping mechanism 83, resistance may occur in the rotation of reel 70. As the resistance increases, carrier tape 72 is more likely to be broken when gripping mechanism 83 moves.

Reel support section 81 may set the rotation amount of reel 70 in accordance with the movement amount of gripping mechanism 83 so that carrier tape 72 does not break when gripping mechanism 83 moves. For example, in the embodiment, gripping mechanism 83 includes first claw portion 83*a*1. Tape releasing device 80 includes first dog 85*a* and first sensor 85*b*. In this case, reel support section 81 estimates the diameter of spiral tape 73 based on the position of first claw portion 83*a*1 when first sensor 85*b* detects that first claw portion 83*a*1 has reached outer peripheral portion 73*a* of spiral tape 73, and sets the rotation amount of reel 70 based on the estimated diameter of spiral tape 73.

Specifically, drive section 84*a* of separation mechanism 84 includes, for example, a position detector such as an encoder. The position detector can detect the distance between the center position of reel 70 supported by reel support section 81 and the position of first claw portion 83*a*1 when first sensor 85*b* detects that first claw portion 83*a*1 has reached outer peripheral portion 73*a* of spiral tape 73. The distance corresponds to the radius of spiral tape 73. Accordingly, reel support section 81 can estimate the diameter of spiral tape 73 based on the distance detected by the position detector.

Reel support section 81 sets the rotation amount of reel 70 based on the estimated diameter of spiral tape 73. Specifically, reel support section 81 calculates the length (circumference) of outer peripheral portion 73*a* of spiral tape 73 from the diameter of spiral tape 73. The length of outer peripheral portion 73*a* is a value obtained by multiplying the diameter of spiral tape 73 by pi. Accordingly, reel support section 81 can recognize the pulled-out amount of carrier tape 72 per unit rotation amount of reel 70. Reel support section 81 acquires the pulled-out amount of carrier tape 72 from the movement amount of gripping mechanism 83, and sets the rotation amount of reel 70 in accordance with the pulled-out amount of carrier tape 72. When the drive shaft of drive section 81*c* of reel support section 81 can be separated, the drive shaft of drive section 81*c* may be separated.

2. Tape Releasing Device 80 and Tape Loading Device 100

Tape releasing device 80 can be provided at any position inside or outside setup device 10. For example, tape releasing device 80 can be provided near tape loading mechanism 23 and reel transfer mechanism 40 (for example, placement area 22*d*, or the like). Placement of reel 70 on placement section 81*a* of reel support section 81 may be performed by the worker or may be performed by reel transfer mechanism 40, or the like. Further, reel 70 from which fixing tape 74 has been released by tape releasing device 80 may be attached to feeder 60 by the worker, or may be attached to feeder 60 by tape loading device 100.

Tape loading device 100 includes tape releasing device 80 and loading section 90. Tape releasing device 80 may take any of the configurations described above. Loading section 90 loads carrier tape 72 of spiral tape 73, from which fixing tape 74 has been released, into feeder 60 that supplies electronic component 91 to collection position 63. Loading section 90 corresponds to tape loading mechanism 23. That is, loading section 90 may include articulated arm 23*a*, camera 23*b*, and fingers 23*c*.

For example, loading section 90 can load carrier tape 72 into feeder 60 by gripping the tip end portion of carrier tape 72, which has been pulled out from spiral tape 73, from which fixing tape 74 has been released, by fingers 23*c*. Reel attachment mechanism 22 can change reel 70, from which fixing tape 74 has been released, from the horizontal posture to the vertical posture, and attach reel 70 to feeder 60 at the work execution position. Tape loading device 100 may include various configurations described above for setup device 10.

3. Modification Example

Detection section 85 need only detect non-adhesive portion 74*b*, and may take various configurations. For example, detection section 85 of the embodiment includes outer peripheral detection section 85*s*, and outer peripheral detection section 85*s* is a contact-type detection section that detects outer peripheral portion 73*a* of spiral tape 73 by bringing gripping mechanism 83 capable of gripping non-adhesive portion 74*b* into contact with outer peripheral portion 73*a* of spiral tape 73. However, detection section 85 may be a non-contact type detection section that detects non-adhesive portion 74*b* without bringing gripping mechanism 83 into contact with outer peripheral portion 73*a* of spiral tape 73. For example, detection section 85 may capture an image of outer peripheral portion 73*a* of spiral tape 73 using the imaging device and detect non-adhesive portion 74*b* based on the captured image. Outer peripheral detection section 85*s* can also detect outer peripheral portion 73*a* of spiral tape 73 using a non-contact type range sensor such as a laser displacement meter.

4. Example of Advantageous Effects of Embodiment

With tape releasing device 80, fixing tape 74 of reel 70 can be released. Tape loading device 100 also includes tape releasing device 80. Therefore, what has been described above with respect to tape releasing device 80 can be said to be the same for tape loading device 100.

REFERENCE SIGNS LIST

60: feeder, 63: collection position, 70: reel, 72: carrier tape, 72*a*: base tape, 72*b*: cover tape, 72*b*1: tip end portion, 72*d*: accommodation section, 73: spiral tape, 73*a*: outer peripheral portion, 74: fixing tape, 74*a*: adhesive portion, 74*b*: non-adhesive portion, 80: tape releasing device, 81: reel support section, 82: release section, 83: gripping mechanism, 83*a*: first gripping mechanism, 83*a*1: first claw portion, 83*b*: second gripping mechanism, 83*b*1: second claw portion, 83*b*2: pressing section, 84: separation mechanism, 85: detection section, 85*a*: first dog, 85*b*: first sensor, 85*c*: second dog, 85*d*: second sensor, 85*s*: outer peripheral detection section, 90: loading section, 100: tape loading device, 91: electronic component.

The invention claimed is:

1. A tape releasing device comprising:

a reel support section configured to support a reel in which an outer peripheral portion of a spiral tape, where a carrier tape, in which a cover tape that closes an accommodation section that accommodates an electronic component is attached to a base tape provided with the accommodation section, is spirally wound, and a tip end portion of the cover tape are fixed by a fixing tape;

a release section configured to release the fixing tape of the reel supported by the reel support section; and a detection section configured to detect a non-adhesive portion that is a portion on a tip end side of the fixing tape, the non-adhesive portion being where an adhesive that fixes the fixing tape and the outer peripheral portion of the spiral tape is not provided, wherein the reel support section rotatably supports the reel, wherein the detection section includes an outer peripheral detection section configured to detect the outer peripheral portion of the spiral tape, and detects the non-adhesive portion with reference to the outer peripheral portion of the spiral tape detected by the outer peripheral detection section, wherein the release section includes a gripping mechanism capable of gripping the non-adhesive portion that is the portion on the tip end side of the fixing tape, the non-adhesive portion being where an adhesive that fixes the fixing tape and the outer peripheral portion of the spiral tape is not provided, the gripping mechanism including a first claw portion that is insertable between the outer peripheral portion of the spiral tape and the non-adhesive portion, and a second claw portion capable of clamping the non-adhesive portion with the first claw portion, and wherein the detection section includes:

a dog which is displaced when one of the first and second claw portions moves toward the outer peripheral portion of the spiral tape and reaches the outer peripheral portion of the spiral tape, and a sensor configured to detect that the one of the first and second claw portions has reached the outer peripheral portion of the spiral tape by the displacement of the dog.

2. The tape releasing device according to claim 1, wherein the gripping mechanism includes:

a pressing section configured to press the non-adhesive portion in a state where the non-adhesive portion is placed on the first claw portion by the second claw portion.

3. The tape releasing device according to claim 1, wherein the detection section includes:

another dog which is displaced when, in a state where the one of the first and second claw portions has reached the outer peripheral portion of the spiral tape, the reel is rotated by the reel support section so that the one of the first and second claw portions is inserted between the outer peripheral portion of the spiral tape and the non-adhesive portion, and reaches an adhesive portion of the fixing tape where the adhesive is provided; and another sensor configured to detect that the the one of the first and second claw portions has reached the adhesive portion of the fixing tape by the displacement of the another dog.

4. The tape releasing device according to claim 1, wherein the release section includes a separation mechanism configured to separate the fixing tape from the cover tape.

5. The tape releasing device according to claim 4, wherein the separation mechanism moves the gripping mechanism in a direction away from the reel in a state where the gripping mechanism grips the non-adhesive portion, and separates the fixing tape from the cover tape.

6. The tape releasing device according to claim 5, wherein the reel support section sets a rotation amount of the reel in accordance with a movement amount of the gripping mechanism so that the carrier tape does not break when the gripping mechanism moves.

7. The tape releasing device according to claim 6, wherein the reel support section estimates a diameter of the spiral tape based on a position of the one of the first and second claw portions when the sensor detects that the one of the first and second claw portions has reached the outer peripheral portion of the spiral tape, and sets the rotation amount of the reel based on the estimated diameter of the spiral tape.

8. A tape loading device comprising:

the tape releasing device according to claim 1; and a loading section configured to load the carrier tape of the spiral tape, from which the fixing tape has been released, to a feeder configured to supply the electronic component to a collection position.

* * * * *